US007887218B2

(12) United States Patent
Wang

(10) Patent No.: US 7,887,218 B2
(45) Date of Patent: Feb. 15, 2011

(54) LED ILLUMINATING DEVICE

(76) Inventor: Baoliang Wang, 4801 Littlejohn St., Suite G, Bladwin Park, CA (US) 91706

( * ) Notice: Subject to any disclaimer, the term of this patent is extended or adjusted under 35 U.S.C. 154(b) by 337 days.

(21) Appl. No.: 12/228,738

(22) Filed: Aug. 15, 2008

(65) Prior Publication Data

US 2008/0310156 A1 Dec. 18, 2008

Related U.S. Application Data

(63) Continuation-in-part of application No. 11/583,470, filed on Oct. 17, 2006, now abandoned.

(51) Int. Cl.
*F21V 15/01* (2006.01)

(52) U.S. Cl. ..... 362/240; 362/249.01; 362/249.02; 362/267

(58) Field of Classification Search ..... 362/800, 362/240, 231, 235–238, 267, 812, 249.01–249.02
See application file for complete search history.

(56) References Cited

U.S. PATENT DOCUMENTS 6,501,084 B1 * 12/2002 Sakai et al. ..... 250/504 R
7,245,279 B2 * 7/2007 Wang ..... 345/84
7,377,669 B2 * 5/2008 Farmer et al. ..... 362/249.01
2005/0213321 A1 * 9/2005 Lin ..... 362/231

* cited by examiner

*Primary Examiner*—Jong-Suk (James) Lee
*Assistant Examiner*—Robert J May
(74) *Attorney, Agent, or Firm*—Raymond Y. Chan; David and Raymond Patent Firm

(57) ABSTRACT

A LED illuminating device includes an illuminating unit and a shell having a top side and chamber. The illuminating unit includes a PCB supported by the shell and one or more LED modules electrically and spacedly mounted on the PCB disposed in the chamber. Each of the LED modules includes a red LED, a blue LED and a green LED which are symmetrically arranged in a triangular manner side by side. The wires are emerged from two ends of the shell in a horizontal plane parallel to an adhesive layer so as to adapt for electrically linking two neighboring LED modules with each other in a flat plane manner. Finally, it reduces unnecessary length of the wire and minimizes the size of the device by decreasing the overall volume.

2 Claims, 10 Drawing Sheets

LED ILLUMINATING DEVICE

CROSS REFERENCE OF RELATED APPLICATION

This is a CIP application of a non-provisional application having an application Ser. No. 11/583,470 and a filing date of Oct. 17, 2006 now abandoned.

BACKGROUND OF THE PRESENT INVENTION

1. Field of Invention

The present invention relates ton illuminating device, and more particularly to a LED illuminating module 2. Description of Related Arts The Light Emitting Diode (LED) is an excellent luminescence power providing many advantages such as lower power consumption and convenient for use. The LED is a fine cold source that can be a monocolor LED which has been widely utilized all over the world on lights and lanterns including traffic light while the chromatic LED, such as trichromatic LED, has been used in the large screen or electronic billboard for displaying figures or words. The arranged shape of LEDs is a rectangle or mounting different shape according to different pictorial circuit board (PCB board) on the billboard, controlled by special hardware and software. The consumer can take attention to preinstall the picture on the screen. In addition, the LEDs have widely been also utilized in family and something else, such as adornment of Christmas tree, etc. . . .

When the device including traffic light, big screen LED and electronic billboard make use of the conventional LEDs, the conventional LEDs having an electronic billboard are schemed out on the product. However, the drawbacks of the conventional LEDs are inflexibility, uncommonality and convenient limited.

Some inventions provide some LED illuminating device for solving previous problem, such as a Chinese patent CN 1191641C which discloses a LED illuminating device comprising an illuminating unit having one or more LEDs and at least one LED chip mounted on a printed board, wherein the LED chip is controlled and driven by a control circuit which is mounted on the printed circuit picture in the circuit board. At least one jack is an electrode terminal of down-lead forming a hollow connecting base pin inserting at least one pylome, regarding as at least one power terminal and a control signal terminal.

The illuminating unit of the LED illuminating device comprising a plurality of LEDs having the same color and forming a LED module electrically connected in series or in parallel. Therefore when multiple colors are needed, many illuminating units should be aligned side by side in a complicated manner.

There is increasing concern that the LED illuminating device is capable of behaving more safety. The conventional LED illuminating device usually comprises a lot of connections between each different LED module. The complicated connection runs through the illuminating unit and the power source may result in high electrical consumption and overheating of the whole LED package. Thus, it will cause a short circuit of the circuit board or device failure.

On the other hand, in recent years, the material cost of the copper has become more and more expensive. The production of the LED illuminating device usually consumes lots of wire material. Thus, it not only increase the manufacturing cost while producing the LED illuminating device, but also leads to a bulky appearance and difficult operation. It is necessary to find a new and cost effective method to produce the LED illuminating device.

SUMMARY OF THE PRESENT INVENTION

A main object of the present invention is to provide a LED illuminating device, wherein the blue, green, red wire and the illuminating unit power lines are adapted to electrically link two neighboring LED modules with each other in a flat plane manner so as to eliminate the permanent angle to be extended parallelly from one end of the neighboring LED module to another LED module. In other words, through this method, the elimination of the permanent angle increases the efficiency of assembly because the wire doesn't need to bend. Finally, it reduces unnecessary length of the wire and minimizes the size of the device by decreasing the overall volume.

Another object of the present invention is to provide a LED illuminating device, wherein the blue, green, red wire and the illuminating unit power lines are adapted to electrically link two neighboring LED modules with each other in a flat plane manner therefore reducing the chance of short-circuits and errors in production.

Another object of the present invention is to provide a LED illuminating device, wherein the blue, green, red wire and the illuminating unit power lines are adapted to electrically link two neighboring LED modules with each other in a flat plane manner so as to increase the endurance of the LED illuminating device because it doesn't have to bend the wire during assembling and disassembling.

Another object of the present invention is to provide a LED illuminating device, wherein the blue, green, red wire and the illuminating unit power lines are adapted to electrically link two neighboring LED modules with each other in a flat plane manner so as to reduce the length of the connection and power wire. Thus, it dramatically reduces the material cost when producing.

Another object of the invention is to provide a LED illuminating device which is adapted to generating a line of light source from a plurality of discrete points of light sources, so as to enhance the convenient of the operation of the LED illuminating device.

Another object of the present invention is to provide a LED illuminating device which is adapted to generate a different color source of light, and which is simple in structure and non-fragile, consumes less energy as compared with conventional neon lights and fluorescent lamps, and generates less heat when operating.

Another object of the present invention is to provide a LED illuminating device comprising many LED illuminating lights connected by four wires including a red wire, a green wire, a blue wire, and a power supply wire so as to optimally control every LED module by corresponding wires.

Another object of the present invention is to provide a LED illuminating device comprising a waterproof LED illuminating formed by sealed affuseing transparent epoxy between the PCB board and the shell enabling the LED illuminating device to be used in a wide variety of environments and convenient installation.

Another object of the present invention is to provide a LED illuminating device which does not involve any expensive or complicated electrical or mechanical components so as to minimize the manufacturing cost and the ultimate selling price of the present invention.

In addition, another object of the present invention is to provide a LED illuminating device using single device or multi-device.

Another object of the present invention is to provide a LED illuminating device which is to be alternatives to neon lighting so as to provide many advantages such as freight cost reduction and usefulness.

Accordingly, in order to accomplish the above objects, the present invention provides a LED illuminating device, comprising:

a shell having a top side and a chamber indented in the top side, defining a peripheral wall upwardly extended from a bottom wall of the chamber; and an illuminating unit comprising a PCB supported by the shell and one or more LED modules electrically and spacedly mounted to the PCB disposed in the chamber, each of the LED modules including a red LED, a blue LED and a green LED which are symmetrically arranged in a triangular manner side by side, two terminals of the PCB being connected with root portions of the wires which includes electrical wires to electrically connect with the red, blue and green LEDs of the LED modules respectively and a power wire for connecting with a power source, wherein the shell is filled with transparent or translucence epoxy resin to cover the PCB, the root portions of electrical and power wires and the chamber to seal the illuminating unit in the shell to form an integral body, wherein the wires are emerged out from two ends of the surrounding side of the LED illuminating device to the another neighboring LED illuminating device. The LED module is adapted for accumulating the LEDs of the illuminators within the chamber, so as to merge the points of light source to form a line of source in the chamber.

Therefore, the PCB has three LED modules connected in series, wherein the LEDs having the same color. Four wires including a red wire, a green wire, a blue wire, and a power supply wire, which are welded at each of the two terminals of the illuminating unit. The red, green and blue wires are electrically connected with the red, green and blue LEDs respectively while the source power wire is electrically with the external power source.

The present invention provides many advantages such as simple frame, freight cost reduction, and lower fault, and it is convenience to operate that different color device attach to control respectively.

These and other objectives, features, and advantages of the present invention will become apparent from the following detailed description, the accompanying drawings, and the appended claims.

DETAILED DESCRIPTION OF THE PREFERRED EMBODIMENT

Figure 1:
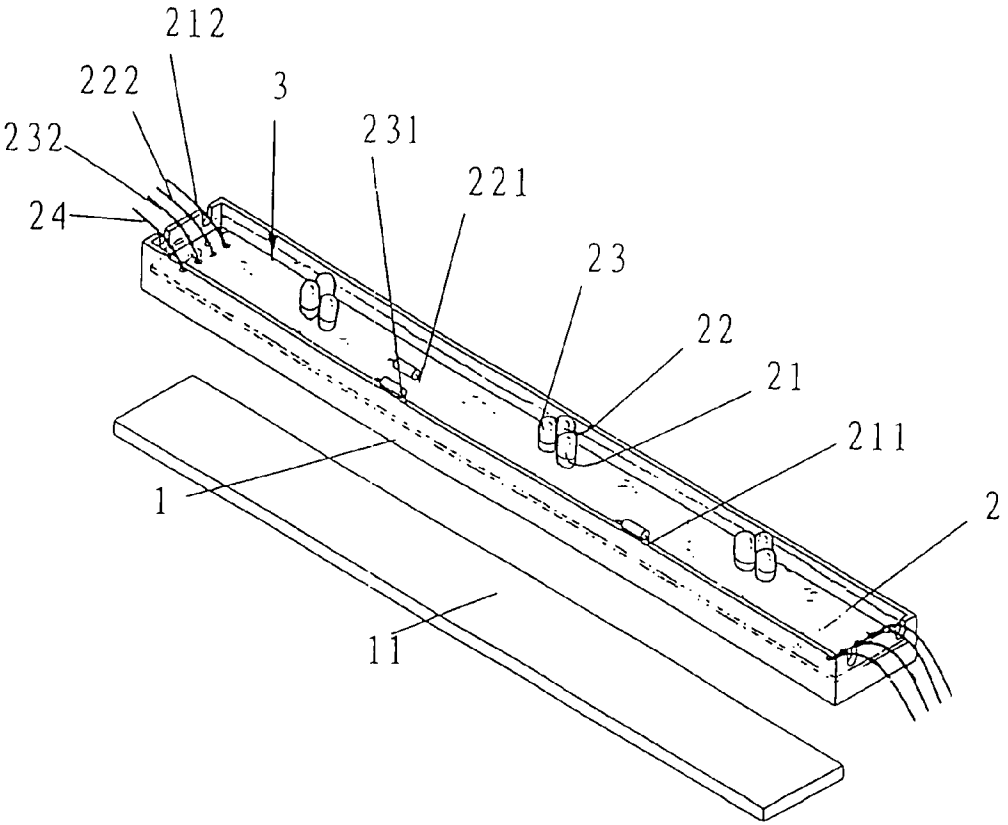
FIG. 1 is a perspective view of a LED illuminating device according to a preferred embodiment of the present invention.
Figure 2:
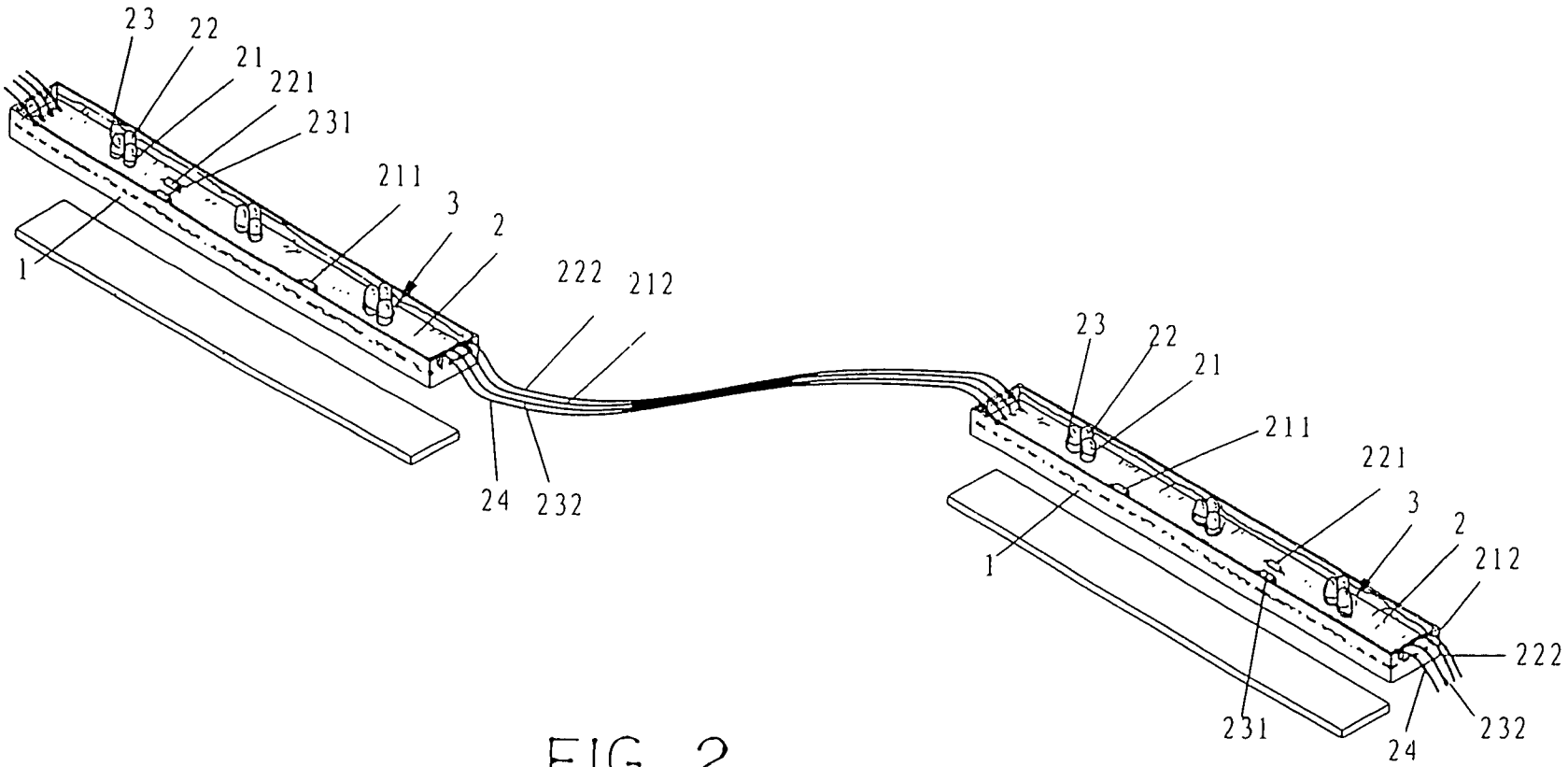
FIG. 2 is a perspective view of the LED illuminating device according to the above preferred embodiment of the present invention.
Figure 3:
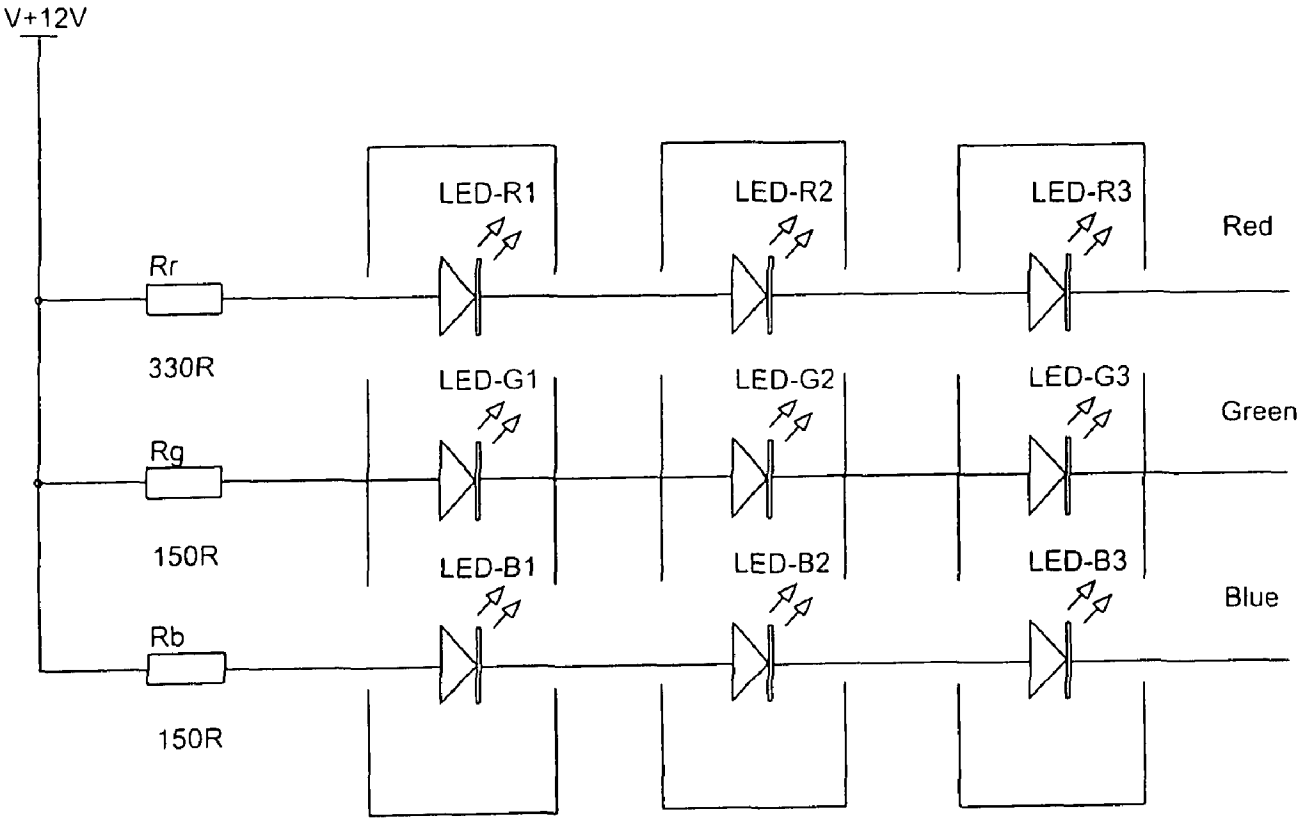
FIG. 3 is a circuit diagram of the LED illuminating device according to the above preferred embodiment of the present invention.

Referring to FIG. 1 to FIG. 3 of the drawings, a LED illuminating device according to a preferred embodiment of the present invention is illustrated, in which the LED illuminating device comprises a shell 1 and an illuminating unit 4.

The shell 1 of salver shape, which is made of non-fragile materials such as plastic materials, has a top side and a chamber 5 indented in the top side, defining a peripheral wall upwardly extended from a bottom wall of the chamber, The illuminating unit 4 comprises a printed circuit board (PCB) 2 supported by the shell 1 and having one or more LEDs 21, 22 and 23 which are electrically and spacedly mounted on a PCB 2 disposed in the chamber 5. There are three LED modules each comprises a red LED 21, a green LED 22, and a blue LED 23 connected in parallel with one another. In other words, the red, blue and green LEDs 21, 22, 23 of each of the LED modules are connected with one another in serial manner. Alternatively, each LED module may include a red LED 21 and a green LED 22 connected in series while connecting a blue LED 23 in parallel. Therefore each LED module is adapted for accumulating the LEDs of the illuminators within the chamber 5, so as to merge points of light source to form a line of lighting in the chamber.

Each of the two terminals the PCB 2 is electrically connected by welding with four wires, generally including a red wire 212, a green wire 222, a blue wire 232, and a power wire 24, wherein the red wire 212, the green wire 222 and the blue wire 232 are connected with the red LED 21, the green LED 22 and the blue LED 23 respectively while the power line 24 is adapted for connecting to a power source.

More specifically, four wires are controlled in beneficial to collocation and in different color LEDs, wherein four wires standing each of the two terminals of the PCB 2 lead-out from two ends of the top side of the shell 1.

Moreover, the red LED 21, the green LED 22 and the blue LED 23 match respectively a red resistance Rr211, a green resistance Rg221 and a blue resistance Rb231. The red LED 21, the green LED 22 and the blue LED 23 is preferably arranged in a triangular manner side by side. The shell is preferred to be made of PVC material. The height of the three-color LEDs 21, 22, 23 is designed to be higher than top of the shell 1. The back side of the shell 1 provides an adhesive layer 11 for attaching with other surfaces or that two sides of the shell 1 can be mounted in a protruding auricular mode for connecting with others.

It is worth mentioning that the LED illuminating device is constructed to form a waterproof structure by means of the affuseing transparent epoxy resin 3 filled in the shell 1 to sealedly envelope the printed circuit board (PCB) 2, the connections of the root portions of the wires 212, 222, 232, 24 with the terminals of the PCB 2, and the chamber of the shell 1. In addition, the wires 212, 222, 232, 24 are permanently angled to be extended parallelly from the ends of the shell 1 to another neighboring LED illuminating devices, wherein the epoxy resin 3 substantially affirms the inclined angle of the root portions so as to ensure the wires extending transversally from the shell.

Referring to FIG. 2 of the drawings, a chain of LED illuminating devices is generally provided by simply connecting the LED illuminating devices with the wires 212, 222, 232, 24 in series. The user can cut off any set of connecting wires 212, 222, 232, 24 to obtain the desired length and number of LED illuminating devices for different applications.

Figure 4:
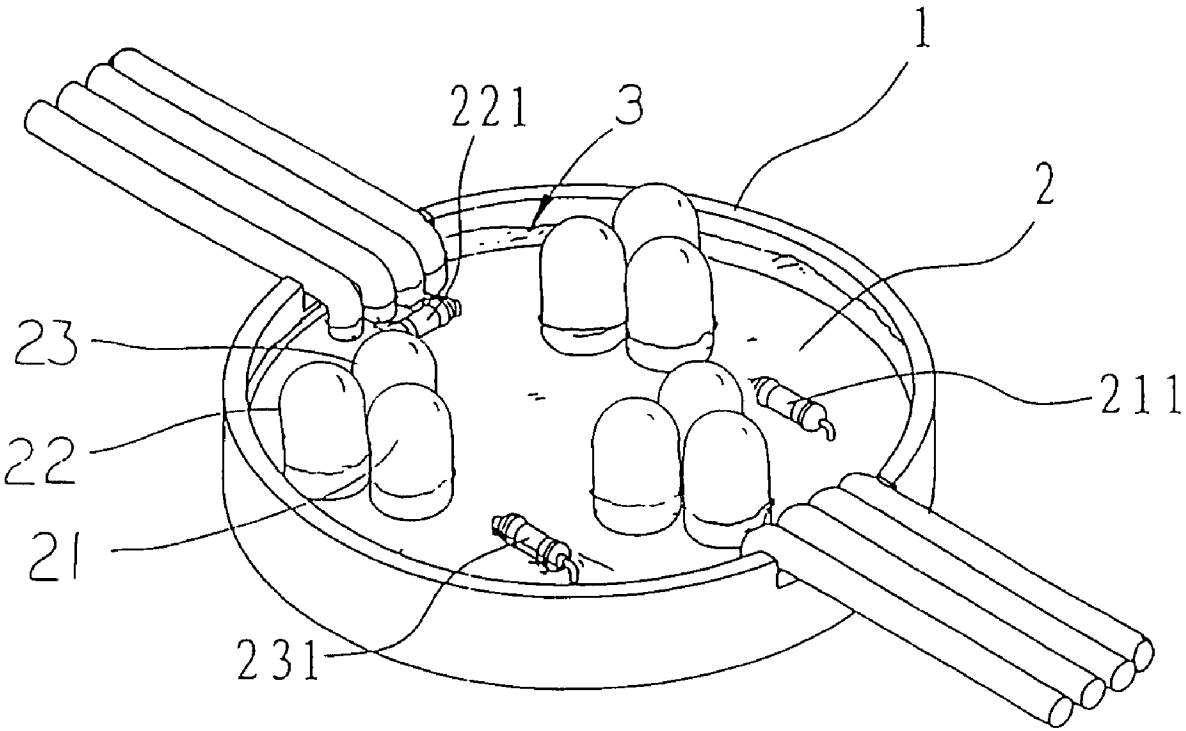
FIG. 4 is illustrates an alternative mode of the above preferred embodiment of the present invention.

Referring to FIG. 4, an alternative mode of the LED illuminating device according to the preferred embodiment of the present invention illustrates an illuminating chain in series, wherein the three LED modules are arranged in a circular shell 1 with the same circuit arrangement as shown in FIG. 3.

Figure 5:
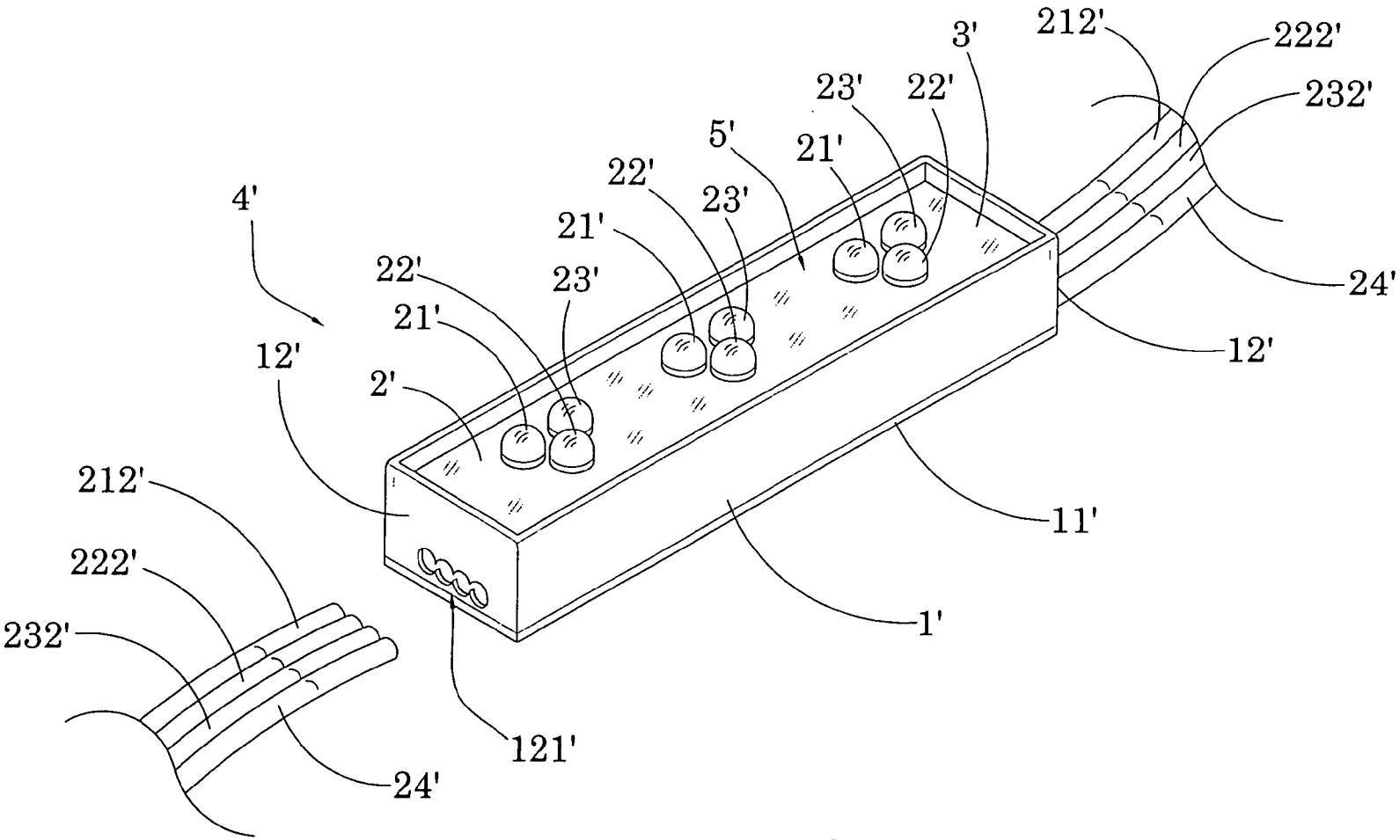
FIG. 5 is a perspective view of a LED illuminating device according to a second preferred embodiment of the present invention.
Figure 6:
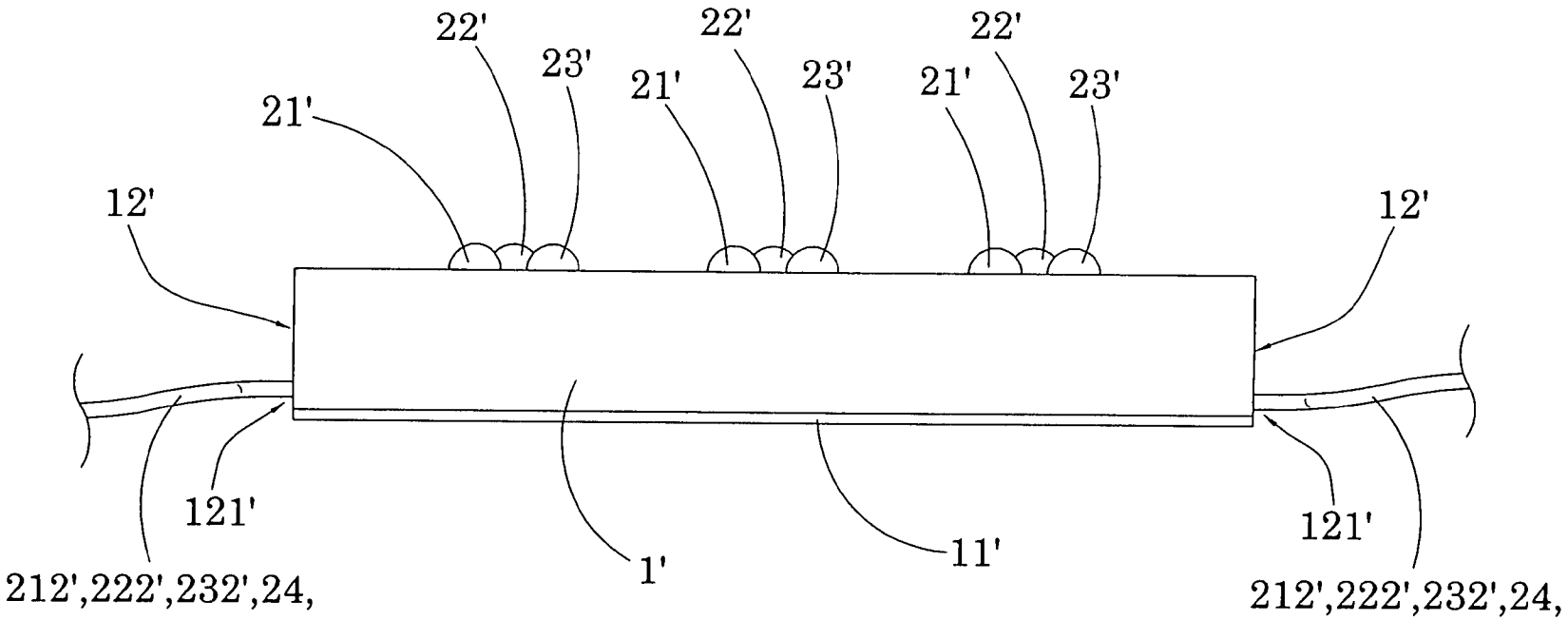
FIG. 6 is a side view of the LED illuminating device according to the above second preferred embodiment of the present invention.
Figure 7:
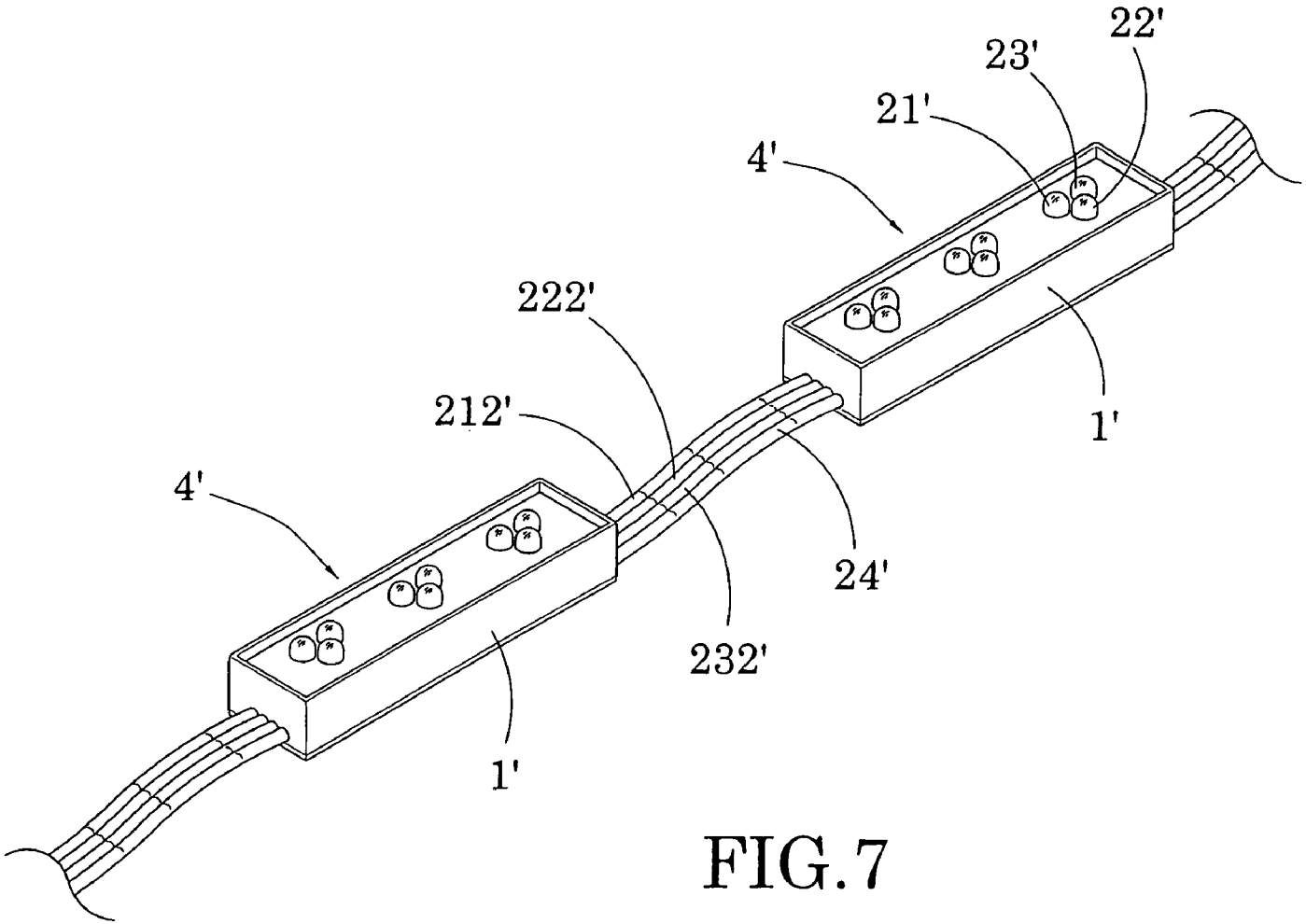
FIG. 7 is a perspective view of the LED illuminating device according to the above second preferred embodiment of the present invention, illustrating the connection between different LED modules.

Referring to FIG. 5 to FIG. 7 of the drawings, a LED illuminating arrangement according to a preferred embodiment of the present invention is illustrated, wherein the LED illuminating arrangement comprises a plurality of LED illuminating devices connected with wires. Each of the LED illuminating devices comprises a shell 1' and an illuminating unit 4'.

The shell 1' of salver shape, which is made of non-fragile materials such as plastic materials, has a top side and a chamber 5' indented in the top side, defining a peripheral wall upwardly extended from a bottom wall of the chamber.

The illuminating unit 4' comprises a printed circuit board (PCB) 2' supported by the shell 1' and having one or more LEDs 21', 22' and 23' which are electrically and spacedly mounted on a PCB 2' disposed in the chamber 5'. There are three LED modules each comprises a red LED 21', a green LED 22', and a blue LED 23' connected in parallel with one another. In other words, the red, blue and green LEDs 21', 22', 23' of each of the LED modules are connected with one another in serial manner. Alternatively, each LED module may include a red LED 21' and a green LED 22' connected in series while connecting a blue LED 23' in parallel. Therefore each LED module is adapted for accumulating the LEDs of the illuminators within the chamber, so as to merge points of light source to form a line of lighting in the chamber 5'.

Each of the two terminals the PCB 2' is electrically connected by welding with four wires, generally including a red wire 212', a green wire 222', a blue wire 232', and a yellow power wire 24', wherein the red wire 212', the green wire 222' and the blue wire 232' are connected with the red LED 21', the green LED 22' and the blue LED 23' respectively while the power line 24' is adapted for connecting to a power source.

More specifically, four wires are controlled in beneficial to collocation and in different color LEDs, wherein four wires standing each of the two terminals of the PCB 2' lead-out from two ends of the surrounding side of the shell 1'.

Moreover, the red LED 21', the green LED 22' and the blue LED 23' match respectively a red resistance, a green resistance and a blue resistance which are coupled underneath the PCB 2'. The red LED 21', the green LED 22' and the blue LED 23' are preferably arranged in a triangular manner side by side. The shell 1' is preferred to be made of PVC material. The height of the three-color LEDs 21', 22', 23' is designed to be higher than top of the shell 1'. The back side of the shell 1' provides an adhesive layer 11' for attaching with other surfaces or that two sides of the shell 1' can be mounted in a protruding auricular mode for connecting with others. Therefore, the LED illuminating devices are adapted for being selectively mounted on the mounting surface at different orientations while being electrically connected through the wires. In other words, two LED illuminating devices can be mounted to the mounting surface at 90° orientation without affecting the electrical connection between the LED illuminating devices.

As shown in second preferred embodiment of the drawing as shown in FIG. 5, the LED illuminating device is constructed to form a waterproof structure by means of the affuseing transparent epoxy resin 3' filled in the shell 1' to sealedly envelope the printed circuit board (PCB) 2', the terminals of the PCB 2', and the chamber 5' of the shell 1'.

According to the second preferred embodiment of the present invention, the wires 212', 222', 232', 24' are now emerge from two ends of the shells 1' in a horizontal plane parallel to an adhesive layer 11' so as to adapt for electrically linking two neighboring LED modules with each other in a flat plane manner.

As shown in FIG. 5, the peripheral wall of the shell 1' comprises two spaced apart sidewalls 12', as the peripheral wall, to define the chamber 5' therebetween, wherein each of the sidewalls 12' has a plurality of guiding holes 121' spacedly formed thereat for the wires 212', 222', 232', 24' sidewardly extending out of the chamber 5' through the guiding holes 121' respectively. The three LED modules are alignedly coupled at the PCB 2' along the shell 1' between the two sidewalls 12' thereof.

Accordingly, there are four guiding holes 121' spacedly formed at each of the sidewalls 12' such that the four wires 212', 222', 232', 24' are extended out of the chamber 5' after the wires 212', 222', 232', 24' are electrically coupled with the PCB 2'. In particularly, the guiding holes 121' are formed at the bottom portion of the respective sidewall 12' to provide a low profile of the LED illuminating device.

As shown in FIG. 5, the guiding holes 121' are aligned side-by-side and are communicated with each other to form a teeth-shaped guiding channel for the wires 212', 222', 232', 24' extending out of the chamber 5'. In addition, the teeth-shaped guiding channel is adapted to securely retain the wires 212', 222', 232', 24' in position so as to prevent the unwanted movement of each of the wires 212', 222', 232', 24' with respect to the shell 1'.

Figure 8:
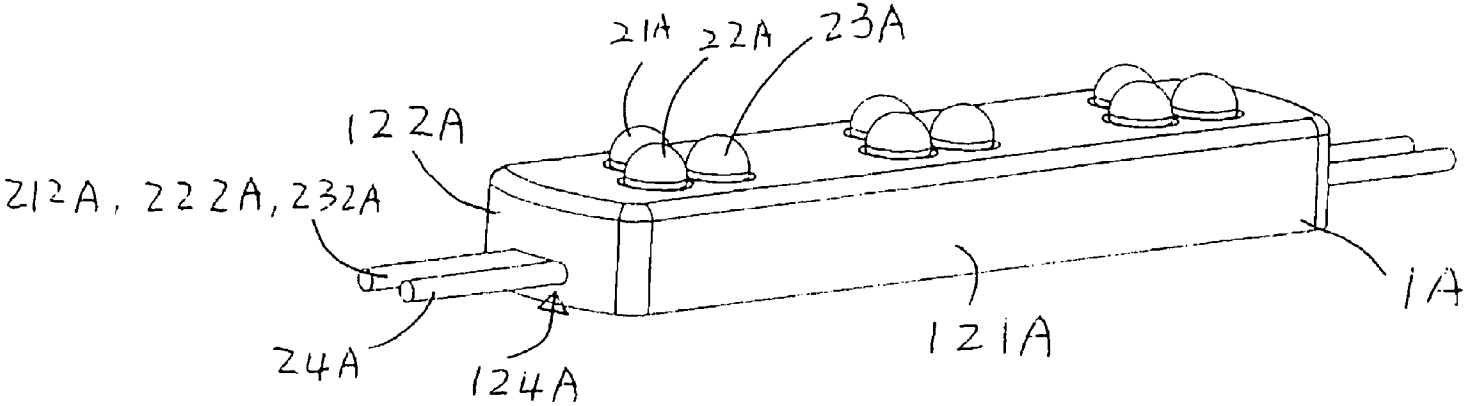
FIG. 8 is a perspective view of the LED illuminating device according to a third preferred embodiment of the present invention.
Figure 9:
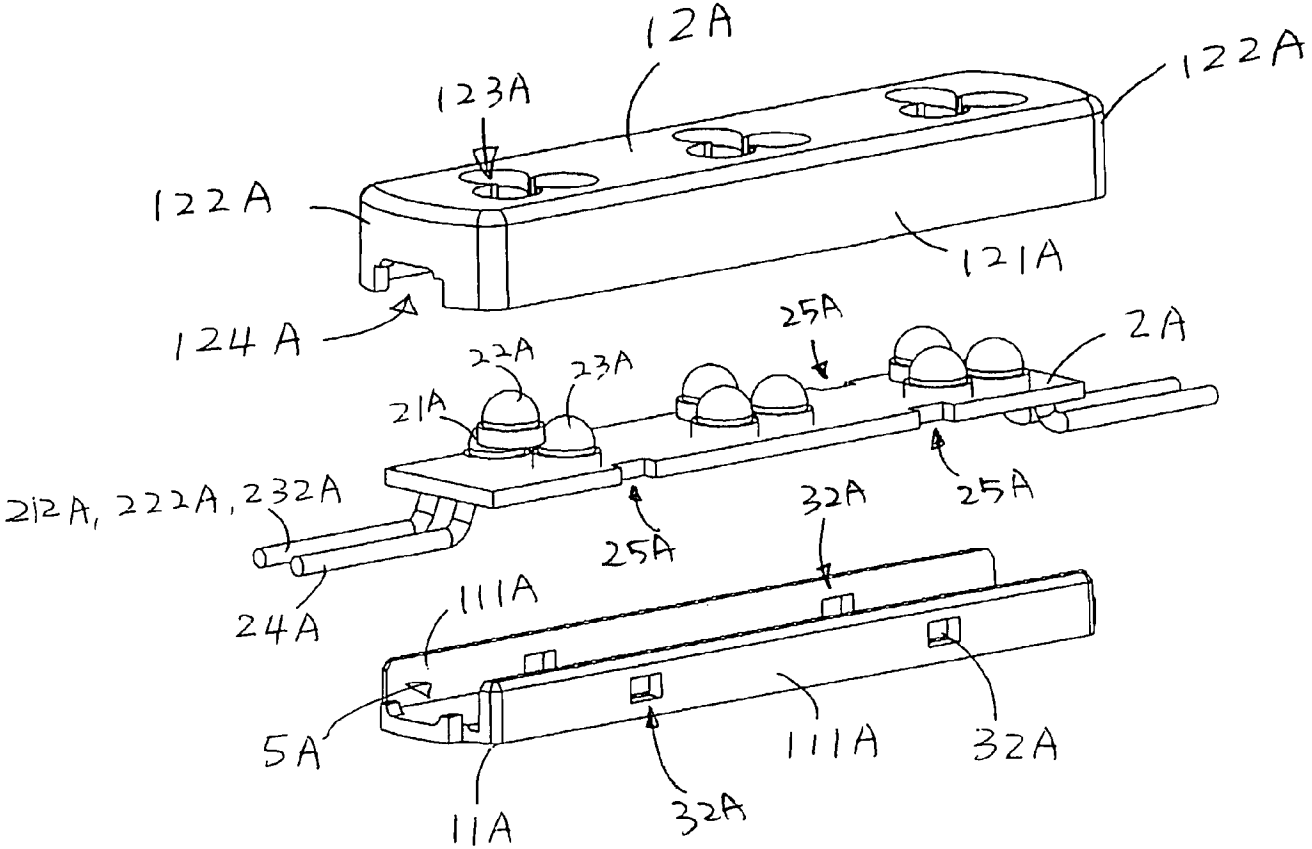
FIG. 9 is an exploded view of the LED illuminating device according to the above third preferred embodiment of the present invention.
Figure 10:
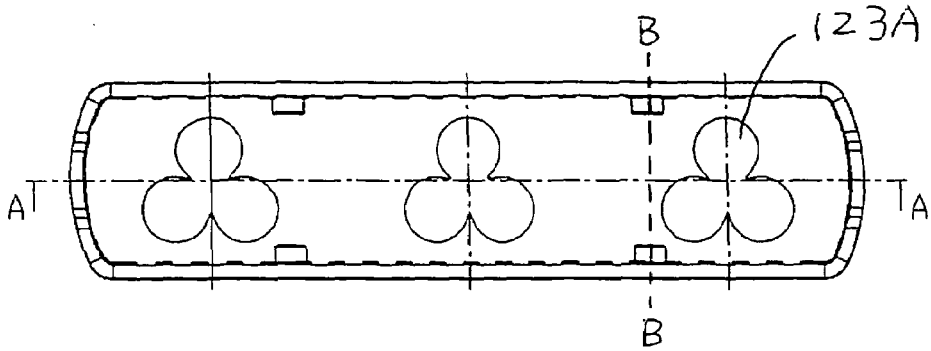
FIG. 10 is a top view of the LED illuminating device according to the above third preferred embodiment of the present invention.

Referring to FIGS. 8 to 10 of the drawings, a LED illuminating arrangement according to a third embodiment of the present invention is illustrated, wherein the LED illuminating arrangement comprises a plurality of LED illuminating devices connected with wires. Each of the LED illuminating devices comprises a shell 1A and an illuminating unit 4A.

The shell 1A, which is made of non-fragile materials such as plastic materials, comprises a supporting base 11A and a cover 12A engaging with the supporting base 11A to define a chamber 5A within the supporting base 11A and the cover 12A.

The illuminating unit 4A comprises a printed circuit board (PCB) 2A supported by the supporting base 11A of the shell 1A and having one or more LEDs 21A, 22A and 23A which are electrically and spacedly mounted on a PCB 2A disposed in the chamber 5A, wherein resin is filled to cover the LEDs 21A, 22A, 23A on the PCB 2A. There are three LED modules each comprises a red LED 21A, a green LED 22A, and a blue LED 23A connected in parallel with one another. In other words, the red, blue and green LEDs 21A, 22A, 23A of each of the LED modules are connected with one another in serial manner. Alternatively, each LED module may include a red LED 21A and a green LED 22A connected in series while connecting a blue LED 23A in parallel. Therefore each LED module is adapted for accumulating the LEDs of the illuminators within the chamber 5A, so as to merge points of light source to form a line of lighting in the chamber 5A.

Each of the two terminals the PCB 2A is electrically connected by welding with four wires, generally including a red wire 212A, a green wire 222A, a blue wire 232A, and a power wire 24A, wherein the red wire 212A, the green wire 222A and the blue wire 232A are connected with the red LED 21A, the green LED 22A and the blue LED 23A respectively while the power line 24A is adapted for connecting to a power source. Accordingly, the red wire 212A, a green wire 222A, a blue wire 232A are constructed to form in one wire structure to minimize the wires being tangled with each other as shown in FIGS. 8 and 9.

More specifically, four wires are controlled in beneficial to collocation and in different color LEDs, wherein four wires standing each of the two terminals of the PCB 2A lead-out from two ends of the surrounding side of the shell 1A.

Moreover, the red LED 21A, the green LED 22A and the blue LED 23A match respectively a red resistance, a green resistance and a blue resistance which are coupled underneath the PCB 2A. The red LED 21A, the green LED 22A and the blue LED 23A are preferably arranged in a triangular manner side by side. The shell 1A is preferred to be made of PVC material. The height of the three-color LEDs 21A, 22A, 23A is designed to be protruded out and higher than the cover 12 of the shell 1A. The back side of the shell 1A provides an adhesive layer for attaching with other surfaces or that two sides of the shell 1A can be mounted in a protruding auricular mode for connecting with others. Therefore, the LED illuminating devices are adapted for being selectively mounted on the mounting surface at different orientations while being electrically connected through the wires. In other words, two LED illuminating devices can be mounted to the mounting surface at 90° orientation without affecting the electrical connection between the LED illuminating devices.

As shown in FIG. 9, the supporting base 11A of the shell 1A comprises two spaced apart base sidewalls 111A. The cover 12A of the shell 1A comprises two spaced apart cover sidewalls 121A, two cover end walls 122A, and a top side of the cover 12A having a plurality of through slots 123A for the LEDs protruding out of the shell 1A as shown in FIG. 10, wherein the supporting base 11A and the cover 12A couple with each other by a lid manner and formed the chamber 5A therebetween. In other words, the cover sidewalls 121A of the cover 12A are overlapped at the outer sides of the base sidewalls 111A of the supporting base 11A when the cover 12A engages with the supporting base 11A to enclose the chamber 5A.

Each of the cover end walls 122A has a guiding slot 124A formed thereat for the wires 212A, 222A, 232A, 24A sidewardly extending out of the chamber 5A through the guiding slots 124A respectively. The three LED modules are alignedly coupled at the PCB 2A within the supporting base 11A and the cover 12A of the chamber 5A therein.

Figure 11:
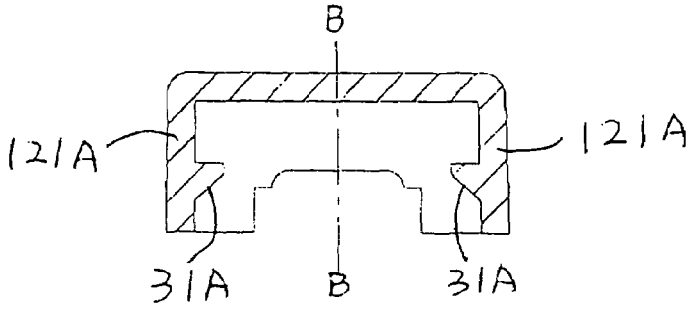
FIG. 11 is a sectional view of a cover of the LED illuminating device according to the above third preferred embodiment of the present invention.
Figure 12:
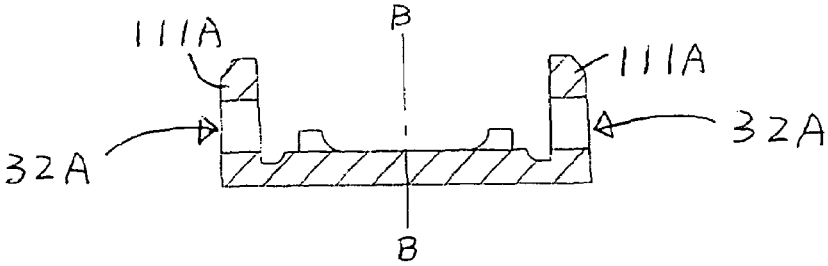
FIG. 12 is a sectional view of a supporting base of the LED illuminating device according to the above third preferred embodiment of the present invention.

Referring to FIGS. 11 and 12, the sectional view of the cover 12A and the supporting base 11A of the shell 1A are illustrated, wherein the cover 12A of the shell 1A has a plurality of locking flanges 31A provided at the inner side of the cover sidewalls 121A of the cover 12A, and the supporting base 11A of the shell 1A has a plurality of locking slots 32A provided at the base sidewalls 111A, so that the locking flanges 31A of the cover 12A engage with the locking slots 32A of the supporting base 11A to form a locking unit 30A to interlock the supporting base 11A with the cover 12A, such that the cover 12A and the supporting base 11A of the shell 1A couple with each other to form the chamber 5A for supporting the illuminating unit 4A.

As shown in FIG. 9, the PCB 2A further has a plurality of cutout portions 25A provided along two side edges of the PCB 2A to align with the locking flanges 31A such that when the PCB 2A is received in the chamber 5A, the locking flanges 31A are engaged with the locking slots 32A through the cutout portions 25A to retain the PCB 2A in position.

Accordingly, there are at least two spaced apart guiding slots 124A formed at each of the cover end walls 122A such that the four wires 212A, 222A, 232A, 24A are extended out of the chamber 5A after the wires 212A, 222A, 232A, 24A are electrically coupled with the PCB 2A. In particularly, the guiding slots 124A are formed at the bottom portion of the respective the cover end walls 122A to provide a low profile of the LED illuminating device.

In the first embodiment of the present invention, the required permanently angled wire increases the length of wire needed. According to the second preferred embodiment of the present invention, the blue, green, red wire, and the illuminating unit power lines are adapted to electrically link two neighboring LED modules with each other in a flat plane manner. In other words, through this method, the elimination of the permanent angle increases the efficiency of assembly because the wire doesn't need to bend. Finally, it reduces unnecessary length of the wire and minimizes the size of the device by decreasing the overall volume.

It is worth mentioning that a flat plane manner method to connect different LED modules eliminates the length of the connection wire and the power wire so as to save lots of material cost when producing. Moreover, such an easy, shorter connection between different modules also reduces the chance of shortcuts and errors. Most important of all, flat plane connection wires between the LED modules instead of permanently angled wires makes the LED module more stable and safe. The conventional LED module usually comprises a complicated connection between the illuminating unit 4 and the power source which is resulted in high electrical consumption and overheating of the whole LED package. The flat plane connection wires between LED modules do not need any bend and cross over to each other so as to provide the most easy and shortest way to transfer the power. Thus, it is easy for people to assemble and disassemble and dramatically reduces the chance of short-circuits.

One skilled in the art will understand that the embodiment of the present invention as shown in the drawings and described above is exemplary only and not intended to be limiting.

It will thus be seen that the objects of the present invention have been fully and effectively accomplished. Its embodiment have been shown and described for the purposes of illustrating the functional and structural principles of the present invention and is subject to change without departure from such principles. Therefore, this invention includes all modifications encompassed within the spirit and scope of the following claims.

What is claimed is:

1. A LED illuminating arrangement, comprising a plurality of LED illuminating devices, wherein said LED illuminating devices are connected with wires, each of said LED illuminating devices comprising a shell having a top side and a chamber indented in said top side, defining a peripheral wall upwardly extended from a bottom wall of said chamber; and an illuminating unit comprising a PCB supported by said shell and one or more LED modules electrically and spacedly mounted on said PCB disposed in said chamber, each of said LED modules including a red LED, a blue LED and a green LED which are symmetrically arranged in a triangular manner side by side, two terminals of said PCB being connected with end portions of said wires, wherein said shell is filled with resin to cover said PCB, wherein said wires are sidewardly extended out said chamber of said shell through said peripheral wall to electrically couple with another said neighboring LED illuminating device, wherein said shell comprises a cover and a supporting base coupling with each other to define said chamber within said cover and said supporting base, wherein said PCB is supported on said supporting base and covered by said cover, wherein said cover has a plurality of through slots provided at a top side of said cover for said LEDs protruding out of said cover through said through slots.

2. The LED illuminating arrangement, as recited in claim 1, further comprising a locking unit for interlocking said supporting base with said cover, wherein said locking unit comprises a plurality of locking slots provided at two base sidewalls of said supporting base and a plurality of locking flanges provided at two cover sidewalls of said cover to engage with said locking slots respectively so as to lock up said cover on said supporting base.

* * * * *